US007022957B2

(12) United States Patent
Bakanowski et al.

(10) Patent No.: US 7,022,957 B2
(45) Date of Patent: Apr. 4, 2006

(54) METHODS AND APPARATUS FOR OPERATING A SPEEDCOOKING OVEN

(75) Inventors: Stephen Michael Bakanowski, Louisville, KY (US); David Laurence Kinny, Louisville, KY (US); Ronald Scott Tarr, Louisville, KY (US); Lawrence Michael Portaro, Louisville, KY (US); Sukumar Dhanpal Bargale, Secunderabad (IN)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/456,305

(22) Filed: Jun. 6, 2003

(65) Prior Publication Data

US 2004/0245246 A1 Dec. 9, 2004

(51) Int. Cl.
*H05B 6/76* (2006.01)

(52) U.S. Cl. ..... 219/741; 174/35 GC

(58) Field of Classification Search ..... 219/741, 219/740, 742, 739, 722, 397, 398, 401; 174/35 GC, 174/35 MS, 35 R; 126/190, 191, 200, 20, 126/20.2, 369; 29/460, 600
See application file for complete search history.

(56) References Cited

U.S. PATENT DOCUMENTS

| | | | | |
|---|---|---|---|---|
| 3,812,306 | A | 5/1974 | Milburn | |
| 4,059,742 | A * | 11/1977 | Baron | 219/741 |
| 4,114,013 | A | 9/1978 | Simon et al. | |
| 4,166,207 | A * | 8/1979 | Burke | 219/741 |
| 4,206,338 | A * | 6/1980 | Katona | 219/740 |
| 4,390,767 | A | 6/1983 | Bucksbaum et al. | |
| 5,494,027 | A | 2/1996 | Maughan | |
| 5,800,159 | A | 9/1998 | Maughan et al. | |
| 6,131,561 | A | 10/2000 | Maxwell et al. | |
| 6,252,206 | B1 * | 6/2001 | Leukhardt et al. | 219/486 |
| 6,371,754 | B1 | 4/2002 | Haynes | |

* cited by examiner

*Primary Examiner*—Quang Van
(74) *Attorney, Agent, or Firm*—H. Neil Houser, Esq.; Armstrong Teasdale, LLP

(57) ABSTRACT

A microwave choke assembly includes a microwave choke, a glass capture channel coupled to the microwave choke, and a gasket positioned at least partially within the glass capture channel, the glass capture channel and a window separated by a first distance.

19 Claims, 8 Drawing Sheets

METHODS AND APPARATUS FOR OPERATING A SPEEDCOOKING OVEN

This invention relates generally to ovens and, more particularly, to an oven operable in speedcooking, microwave, and convection/bake modes.

Ovens typically are either, for example, microwave, radiant, or thermal/convection cooking type ovens. For example, a microwave oven includes a magnetron for generating RF energy used to cook food in an oven cooking cavity. Although microwave ovens cook food more quickly than radiant or thermal/convection ovens, microwave ovens do not brown the food. Microwave ovens therefore typically are not used to cook as wide a variety of foods as radiant or thermal/convection ovens.

Radiant cooking ovens include an energy source such as lamps or resistive sheath elements which generate radiant energy used to cook the food. Radiant ovens brown the food and generally can be used to cook a wider variety of foods than microwave ovens. Radiant ovens, however, cook many foods slower than microwave ovens.

In thermal/convection ovens, the food is cooked by the air in the cooking cavity, which is heated by a heat source. Standard thermal ovens do not have a fan to circulate the hot air in the cooking cavity. Some convection ovens use the same heat source as a standard thermal oven, but add a fan to increase cooking efficiency by circulating the hot air around the food. Other convection ovens include a separate convection element. Such ovens, however, may not cook as fast as radiant or microwave ovens.

One way to achieve speedcooking in an oven is to include both microwave and radiant energy sources, and convection. The combination of microwave and radiant energy sources facilitates fast cooking of foods. In addition, and as compared to microwave only cooking, a combination of microwave and radiant energy sources can cook a wider variety of foods.

While speedcooking ovens are versatile and cook food quickly, cooking appliances that combine conventional and microwave cooking modes must accommodate the requirements of each. For example, a door used in a speedcooking oven must be compatible with both microwave cooking and also conventional self cleaning requirements. Additionally, the door may include a glass window for viewing objects inside the oven. When the door frame is fabricated from a metallic material which is in direct contact with the glass window problems can arise in the microwave cooking modes. For example, if the microwave fields are relatively large in the vicinity of the glass/metal interface, excessive heating may occur causing the glass to crack. The microwave can also generate relatively large microwave fields which may induce arcing through the glass, again damaging the glass. In addition, a glass to metal interface can be the source of large thermally induced stress during the high temperatures needed for the self clean cycle. Other problems may occur if the metal to glass interface is not sufficiently tight. For example, the glass may move freely in the glass/metal interface allowing mechanical damage to occur to the glass during shipping or moving. In addition a seal will not be formed between the cooking cavity and door components beyond the inner glass and door allowing cooking vapors, moisture and gases to escape the cooking cavity thereby reducing visibility and lowering performance of the oven.

BRIEF SUMMARY OF THE INVENTION

In one aspect, a microwave choke assembly is provided. The choke assembly includes a microwave choke, a glass capture channel coupled to the microwave choke, and a gasket positioned at least partially within the glass capture channel, the glass capture channel and a window separated by a first distance.

In another aspect, an oven including a cooking cavity, an RF generation module positioned within the cooking cavity, a convection fan positioned within the cooking cavity, and a window positioned within a door for viewing the cooking cavity is provided. The oven further includes a microwave choke assembly including a microwave choke, a glass capture channel coupled to the microwave choke, and a gasket positioned at least partially within the glass capture channel, the glass capture channel and the window separated by a first distance, the gasket includes only an inner layer and an outer layer, the inner layer including a metallic mesh, the outer layer including a fiberglass material.

In a further aspect, a choke assembly for an oven is provided. The oven includes a door, a microwave choke coupled to the door, a glass capture channel, and an extension apparatus coupling the choke and the glass capture channel. The oven further includes a first metallic screen positioned adjacent the door and a metallic gasket positioned between the first metallic screen and the extension apparatus.

In another further aspect, a method for sealing a window in a speedcook oven is provided. The speedcook oven includes a cooking cavity, an RF generation module positioned within the cooking cavity, a convection fan positioned within the cooking cavity, and a window positioned within a door for viewing the cooking cavity. The oven further includes a microwave choke assembly that includes a microwave choke, and a glass capture channel coupled to the microwave choke. The method includes positioning a gasket at least partially within the glass capture channel, the glass capture channel and the window separated by a first distance; the gasket including only an inner layer and an outer layer, the inner layer including a metallic mesh, the outer layer including a fiberglass material.

DETAILED DESCRIPTION OF THE INVENTION

In the exemplary embodiment, the methods and apparatus described herein are applicable to the operation of an oven that includes sources of radiant and microwave energy as well as a convection heating element, a bake heating element, and a broiler heating element. Although three specific embodiments of such an oven are described herein, it should be understood that the present invention can be utilized in combination with many other such ovens and is not limited to practice with the ovens described herein. For example, one oven described herein below is a speedcook oven including a range. The present invention, however, is not limited to practice with just full-size ovens that include a rangetop, but can be used with many other types of ovens such as countertop or built-in wall ovens, over the range type ovens, and a double wall oven.

Figure 1:
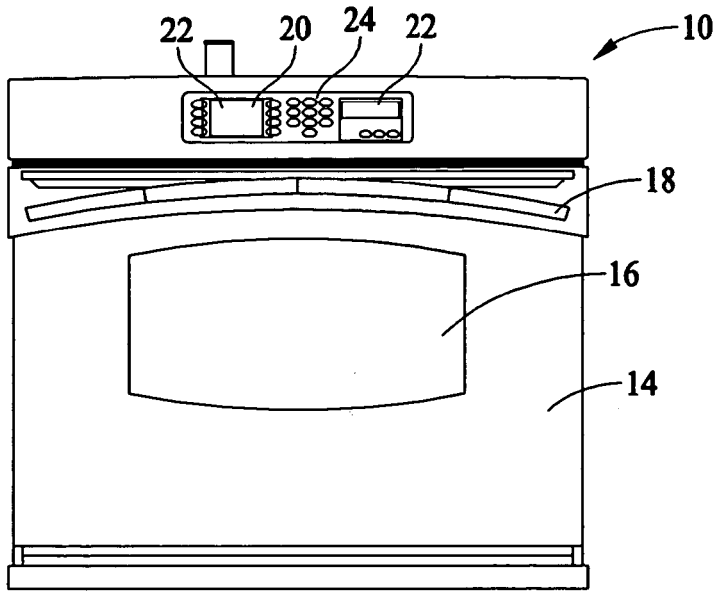
FIG. 1 is a front view of a speedcook wall oven.
Figure 2:
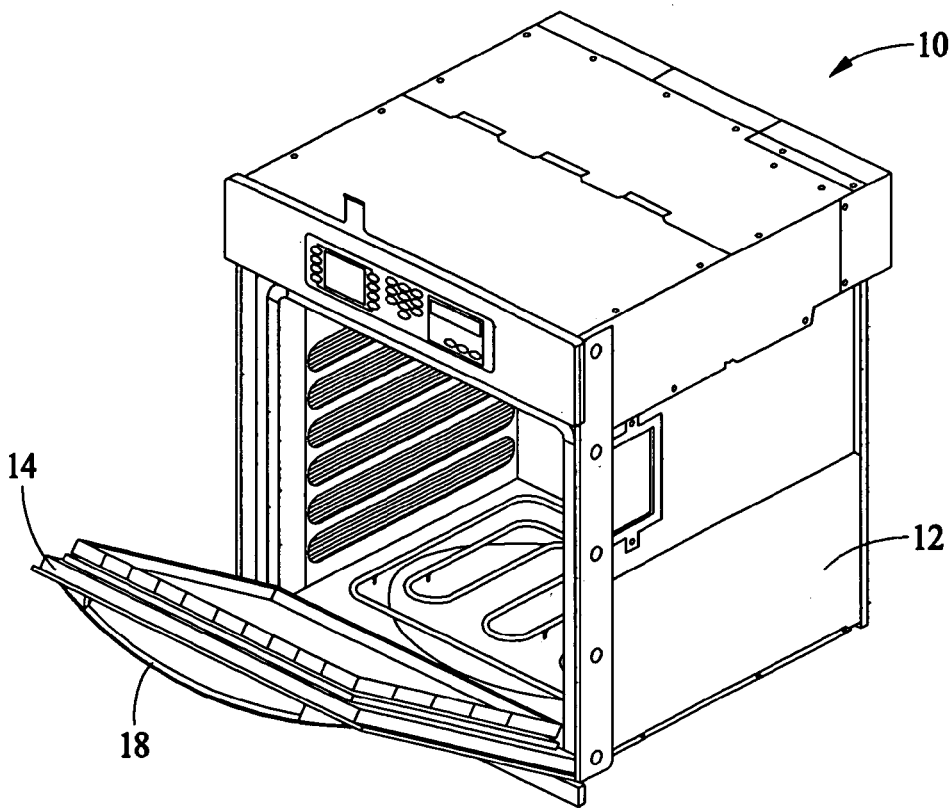
FIG. 2 is a perspective view of the oven shown in FIG. 1.
Figure 3:
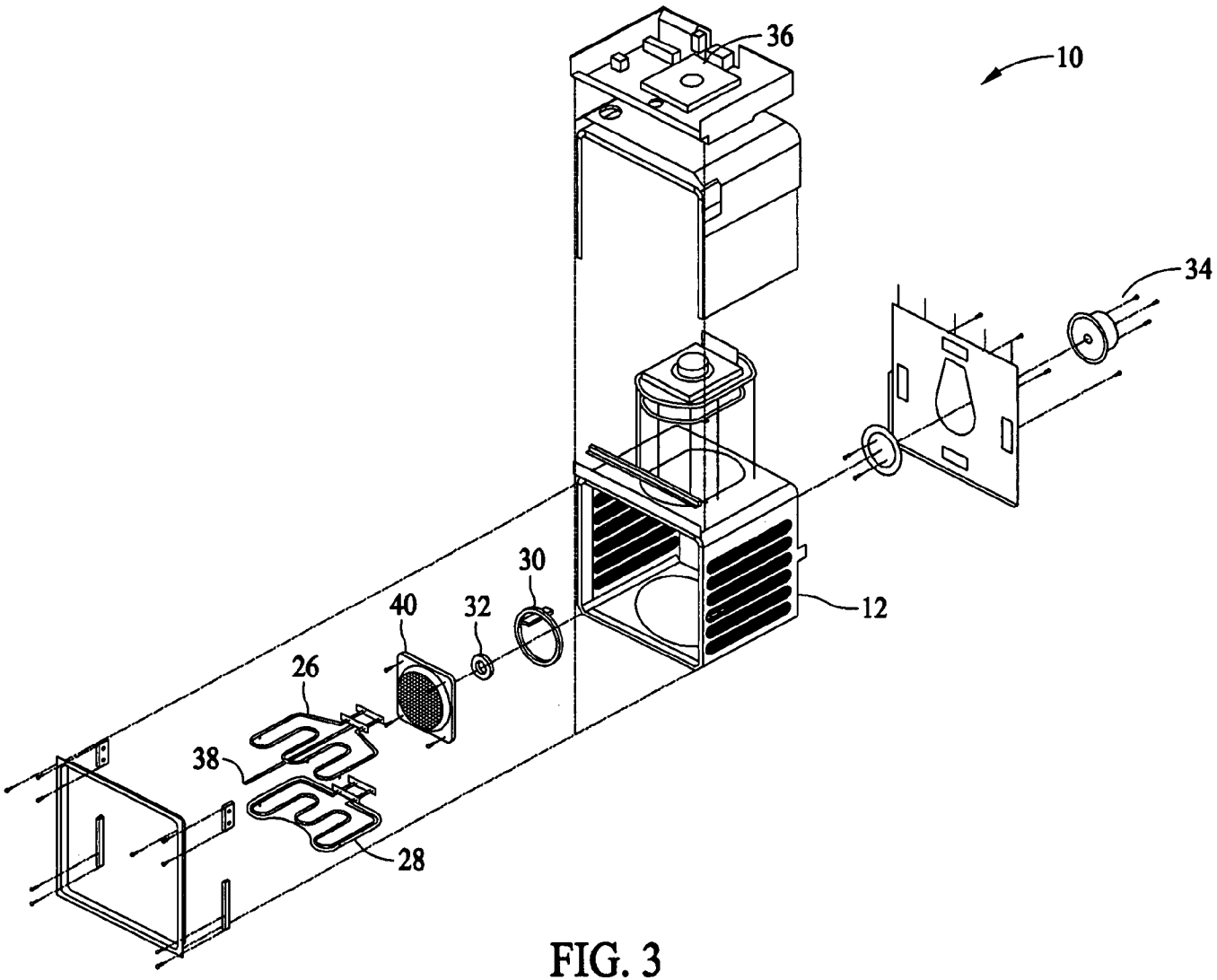
FIG. 3 is an exploded view of the oven shown in FIG. 1 and FIG. 2.

FIG. 1 is a front view of a speedcook oven 10. FIG. 2 is a perspective view of speed cook oven 10. FIG. 3 is an exploded view of the oven shown in FIG. 1 and FIG. 2. In the exemplary embodiment, speedcook oven 10 includes an oven cavity 12, a door 14 including a window 16 provided for viewing food in oven cooking cavity 12, and a handle 18 secured to door 14. Oven 10 also includes a control panel 20 that includes at least one display 22, a plurality of tactile control buttons 24, and various knobs or dials.

Speedcooking oven 10 includes a broil heating element 26, a bake heating element 28, a convection heating element 30, a convection fan 32, and a convection motor 34 mechanically coupled to convection fan 32 such that heat generated by convection element 30 is provided to oven cavity 12. Speedcooking oven 10 also includes a magnetron 36 and a temperature sensor 38 configured to sense the temperature within cavity 12. Broil heating element 26 is located at a top area inside speedcooking oven 10 and bake heating element 28 is located at a bottom area inside speedcooking oven 10. Convection heating element 30 and convection fan 32 are located at a back area inside speedcooking oven 10. A cover 40 can be provided to shield a user from convection heating element 30 and convection fan 32. Magnetron 36 is located above broil heating element 26.

Magnetron 36 generates microwave energy to speed cook various food items, which are supported by a rack (not shown). The microwaves are evenly distributed inside speedcooking oven 10 by a microwave dispersement plate (not shown) positioned between magnetron 36 and broil heating element 26. The microwave dispersement plate is similar to the match plate described in U.S. Pat. No. 6,452,142. Door 14 of speedcooking oven 10 allows access to speedcooking oven 10.

Figure 4:
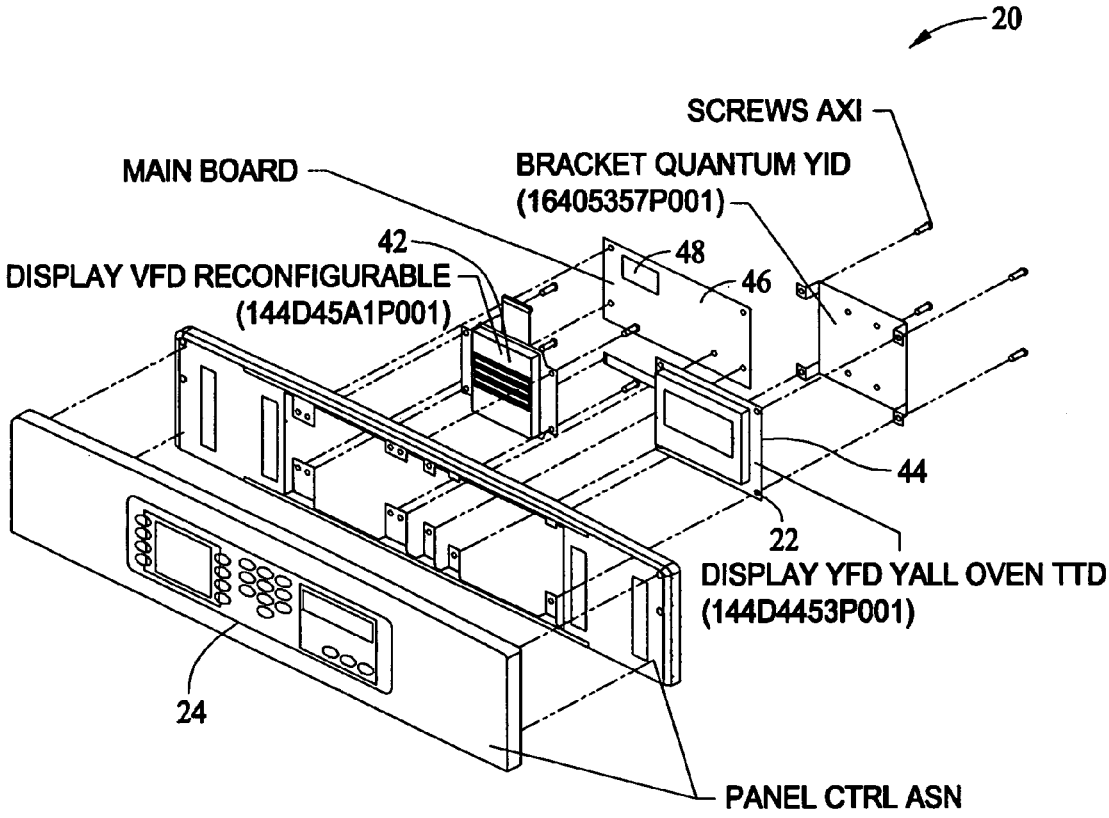
FIG. 4 is an exploded view of control panel that can be used with the oven shown in FIG. 1, FIG. 2, and FIG. 3.

FIG. 4 is an exploded view of control panel 20 that includes a first display 42, a second display 44, and a control board 46. In the exemplary embodiment, first display 42 is an alphanumeric menu display 42 that allows the user to choose between various functions that speedcooking oven 10 performs, and second display 44 is a status display 44 that notifies the user of various conditions inside speedcooking oven 10. For example, status display 44 can notify the user that the temperature inside speedcooking oven 10 is 327 degrees Fahrenheit.

Speedcooking oven 10 also include a microprocessor 48 positioned on a control board 46 and electrically coupled to alphanumeric display 42. Microprocessor 48 is configured to operate various components of oven 10, such as, but not limited to, broiler heating element 26, bake heating element 28, convection fan 32, magnetron 36, and convection heating element 30. In the exemplary embodiment, temperature sensor 38 is located at least partially within cavity 12 and microprocessor 48 is configured to receive an input from temperature sensor 38. Microprocessor 48 is programmed to perform functions described herein, and as used herein, the term microprocessor is not limited to just those integrated circuits referred to in the art as microprocessors, but broadly refers to computers, processors, microcontrollers, microcomputers, programmable logic controllers, application specific integrated circuits, and other programmable logic circuits, and these terms are used interchangeably herein.

In use, cooking selections are made by depressing tactile control buttons 24 and when the desired selection is displayed, pressing a start button. For example, many cooking algorithms can be preprogrammed in the oven memory for many different types of foods. When a user is cooking a particular food item for which there is a preprogrammed cooking algorithm, the preprogrammed cooking algorithm is selected by operating the control buttons 24 until the selected food name is displayed and then pressing a start button. Instructions and selections are displayed on display 44.

Figure 5:
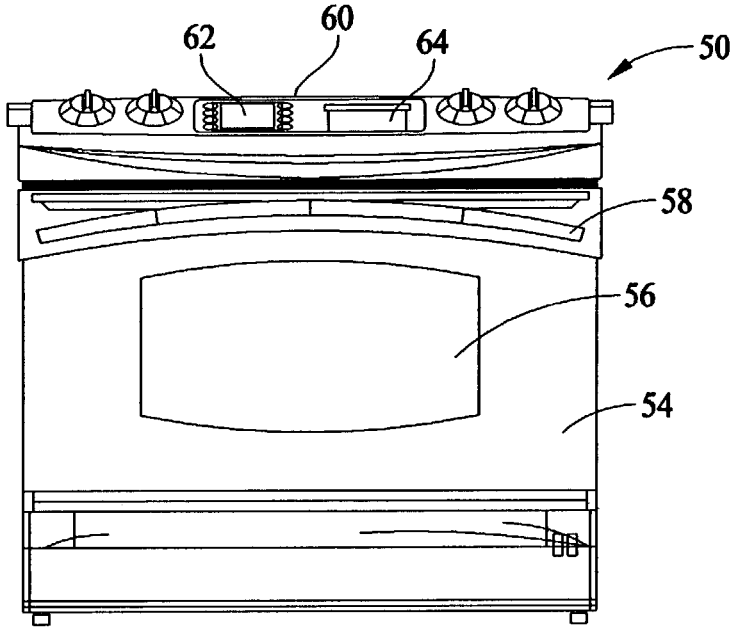
FIG. 5 is a front view of a speedcook range.
Figure 6:
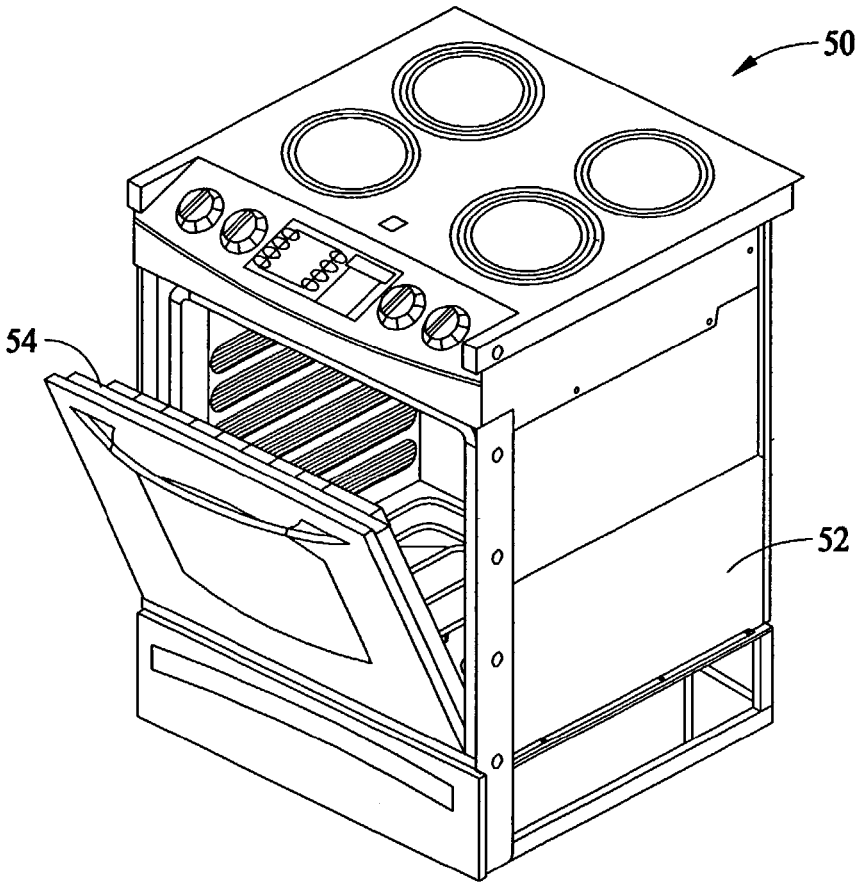
FIG. 6 is a perspective view of the oven shown in FIG. 4.
Figure 7:
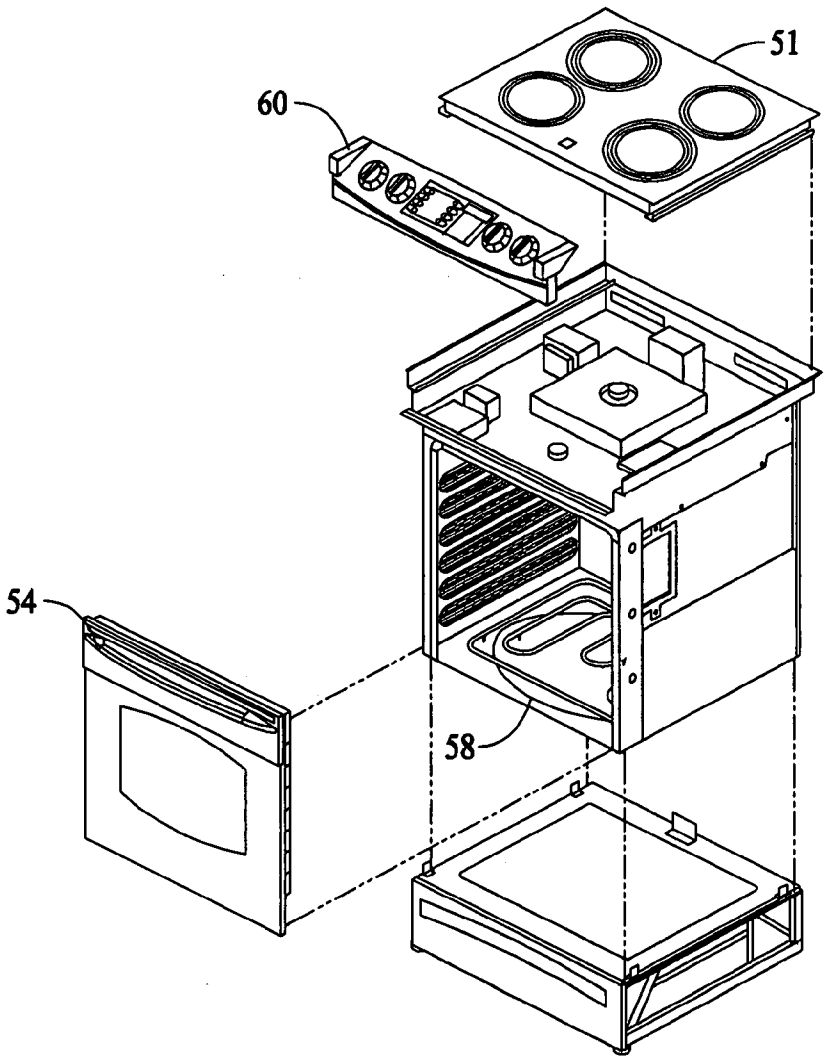
FIG. 7 is an exploded view of the oven shown in FIG. 5.

FIG. 5 is a front view of a speedcook oven 50 including a rangetop 51. FIG. 6 is a perspective view of speed cook oven 50. FIG. 7 is an exploded view of the oven shown in FIG. 5 and FIG. 6. In the exemplary embodiment, speedcook oven 50 includes an oven cavity 52, a door 54 including a window 56 provided for viewing food in oven cooking cavity 52, and a handle 58 is secured to door 54. Oven 50 also includes a control panel 60 that includes at least one display 62, a plurality of tactile control buttons 64, and various knobs or dials.

Speedcooking oven 50 includes a broil heating element (not shown), a bake heating element 59, a convection heating element (not shown), a convection fan (not shown), and a convection motor (not shown) mechanically coupled to the convection fan such that heat generated by the convection element is provided to oven cavity 52. Speedcooking oven 50 also includes a magnetron (not shown) and a thermistor (not shown) configured to sense the temperature within cavity 52. In the exemplary embodiment, the broil heating element is located at a top area inside speedcooking oven 50 and bake heating element 59 is located at a bottom area inside speedcooking oven 50. The convection heating element and the convection fan are located at a back area inside speedcooking oven 50. A cover (not shown) can be provided to shield a user from the convection heating element and the convection fan. The magnetron is located approximately above the broil heating element.

The magnetron generates microwave energy to speed cook various food items, which are supported by a rack (not shown). The microwaves are evenly distributed inside speedcooking oven 50 by a microwave disbursement plate (not shown) positioned between the magnetron and the broil heating element. Door 54 of speedcooking oven 50 allows access to speedcooking oven 50. In the exemplary embodiment, speedcooking oven 50 also includes control panel 20 shown in FIG. 4.

In use, cooking selections are made by depressing tactile control buttons 24 and when the desired selection is displayed, pressing a start button. For example, many cooking algorithms can be preprogrammed in the oven memory for many different types of foods. When a user is cooking a particular food item for which there is a preprogrammed cooking algorithm, the preprogrammed cooking algorithm is selected by operating the control buttons 64 until the selected food name is displayed and then pressing a start button. Instructions and selections are displayed on the display.

Figure 8:
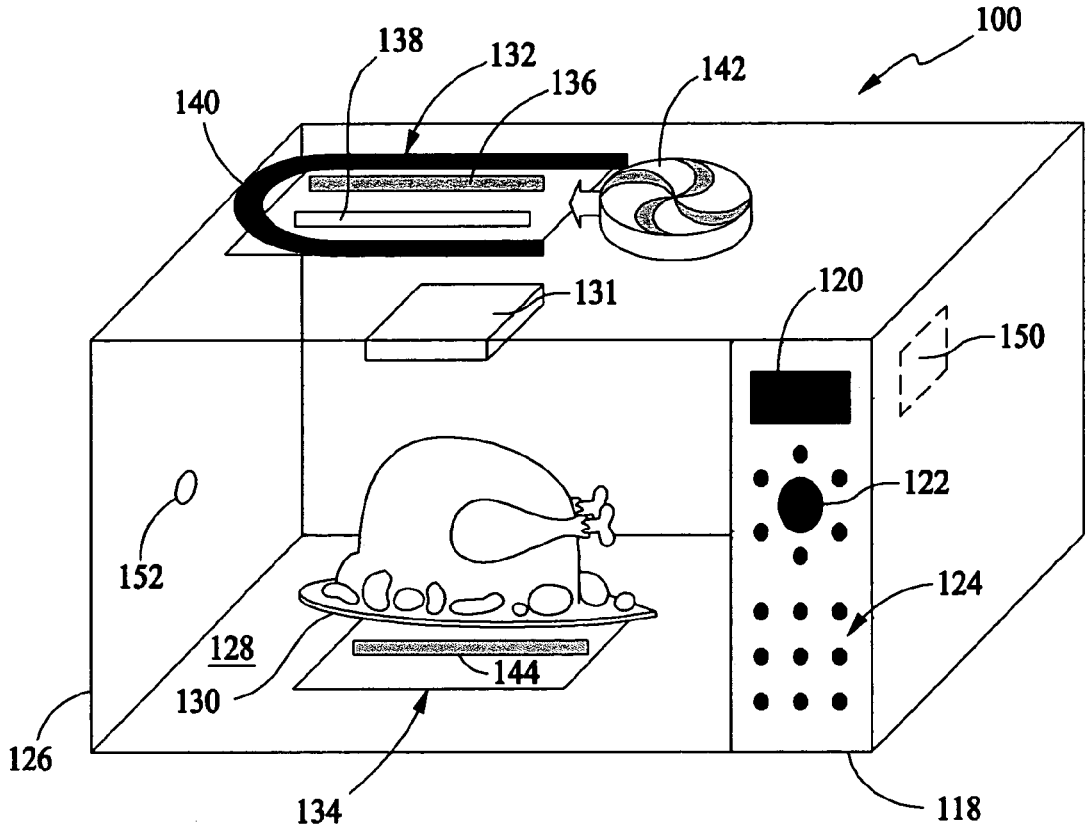
FIG. 8 is another exemplary embodiment of a speedcooking oven that can be used with the methods described herein

FIG. 8 is a front view of an over the range type oven 100 that includes a control panel 118 that includes a display 120, at least one injection molded knob or dial 122, and a plurality of tactile control buttons 124.

In use, cooking selections are made by rotating dial 122 clockwise or counter-clockwise and when the desired selection is displayed, pressing dial 122. For example, many cooking algorithms can be preprogrammed in the oven memory for many different types of foods. When a user is cooking a particular food item for which there is a preprogrammed cooking algorithm, the preprogrammed cooking algorithm is selected by rotating dial 122 until the selected food name is displayed and then pressing the dial. Instructions and selections are displayed on vacuum fluorescent display 120.

Speedcooking oven 100 also includes a shell 126, and a cooking cavity 128 located within shell 126. Cooking cavity 128 is constructed using high reflectivity (e.g., 72% reflectivity) stainless steel, and a turntable 130 is located in cavity 128 for locating food. Oven 100 includes a microwave module 131, an upper heater module 132, and a lower heater module 134. Microwave module 131 includes a magnetron located on a side of cavity. Magnetron, in an exemplary embodiment, delivers a nominal 900 W into cavity according to standard IEC (International Electromechanical Commission) procedure. Upper heater module 132 includes radiant heating elements illustratively embodied as a ceramic heater 136 and a halogen cooking lamp 138. In the exemplary embodiment, ceramic heater 136 is rated at 600 W and halogen cooking lamp 138 is rated at 500 W. Upper heater module 132 also includes a sheath heater 140. In the exemplary embodiment, sheath heater 140 is rated at 1100 W. A convection fan 142 is provided for blowing air over heating elements and into cooking cavity 128. Lower heater module 134 includes at least one radiant heating element illustrated as a ceramic heater 144 rated at 375 W.

The specific heating elements and RF generation system (e.g., a magnetron) can vary from embodiment to embodiment, and the elements and system described above are exemplary only. For example, upper heater module 132 can include any combination of heaters including combinations of halogen lamps, ceramic lamps, and/or sheath heaters. Similarly, lower heater module 134 can include any combination of heaters including combinations of halogen lamps, ceramic lamps, and/or sheath heaters. In addition, the heaters can all be one type of heater. The specific ratings and number of lamps and/or heaters utilized in upper heater module 132 and lower heater module 134 can vary from embodiment to embodiment. Generally, the combinations of lamps, heaters, and RF generation system is selected to provide the desired cooking characteristics for speedcooking, microwave, and convection/bake modes.

Speedcooking oven 100 also includes a temperature sensor 150 located at least partially within shell 126 and a microprocessor 152 configured to receive an input from temperature sensor 150, and is also configured to operate various components of oven 100, such as, but not limited to, upper heater module 132, lower heater module 134, convection fan 142, and the magnetron. Microprocessor 152 is programmed to perform functions described herein, and as used herein, the term microprocessor is not limited to just those integrated circuits referred to in the art as microprocessors, but broadly refers to computers, processors, microcontrollers, microcomputers, programmable logic controllers, application specific integrated circuits, and other programmable logic circuits, and these terms are used interchangeably herein.

Figure 9:
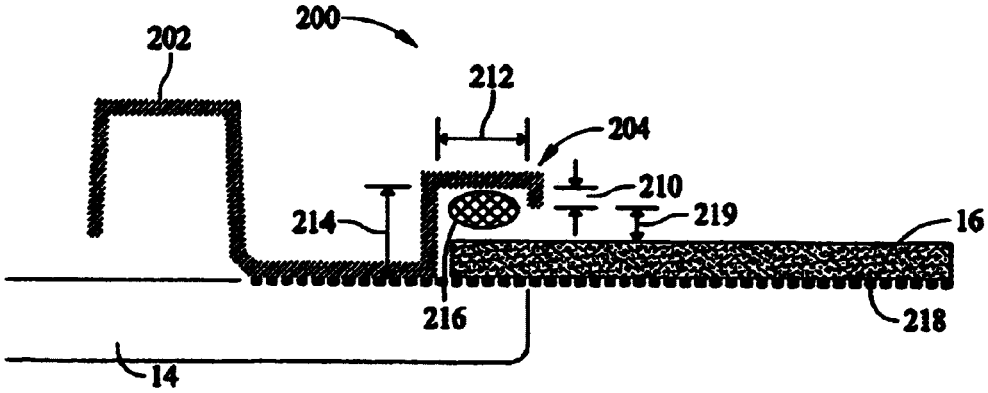
FIG. 9 is a side view of a microwave choke assembly.

FIG. 9 is a side view of a microwave choke assembly 200 that can be used with at least one of speedcooking oven 10, speedcooking oven 50, and speedcooking oven 100. Choke assembly 200 includes a microwave choke 202 and a glass capture channel 204. In one embodiment, choke assembly 200 is unitary and includes microwave choke 202 and glass capture channel 204. In another embodiment, microwave choke 202 and glass capture channel 204 are not unitary, but mechanically coupled to form choke assembly 200. Glass capture channel 204 includes a first side 210, a second side 212 substantially perpendicular to first side 210, and a third side 214 substantially perpendicular to second side 212 and substantially parallel to first side 210. In one embodiment, first side 210 is between approximately 0.10 inches and approximately 0.12 inches in length. In another embodiment, first side 210 is between approximately 0.05 inches and approximately 0.17 inches in length. In another embodiment first side 210 is approximately 0.11 inches in length. In one embodiment, second side 212 is between approximately 0.18 inches and approximately 0.28 inches in length. In another embodiment, second side 212 is between approximately 0.5 inches and approximately 0.43 inches in length. In another embodiment second side 212 is approximately 0.23 inches in length. In one embodiment, third side 214 is between approximately 0.18 inches and approximately 0.28 inches in length. In another embodiment, second side 212 is between approximately 0.5 inches and approximately 0.43 inches in length. In another embodiment second side 212 is approximately 0.23 inches in length. Choke assembly 200 also includes at least one gasket 216 positioned at least partially within glass capture channel 204.

In use, a door screen 218 is positioned adjacent oven door 14, such as, but not limited to, door 14. A window, such as, but not limited to window 16 is positioned adjacent door 14. Choke assembly 200, including gasket 216, is then positioned adjacent to window 16, screen 218 and door 14, such that gasket 216 is at least partially compressed between window 16 and glass capture channel 204 and such that glass capture channel 204 and window 16 are separated by a first distance 219. Gasket 216 facilitates preventing a metal to glass contact while holding glass window 16 in a substantially fixed position with respect to door 14. Additionally, gasket 216 facilitates preventing vapor and moisture from an interior of oven 10 from exhausting to the exterior of oven 10.

Figure 10:
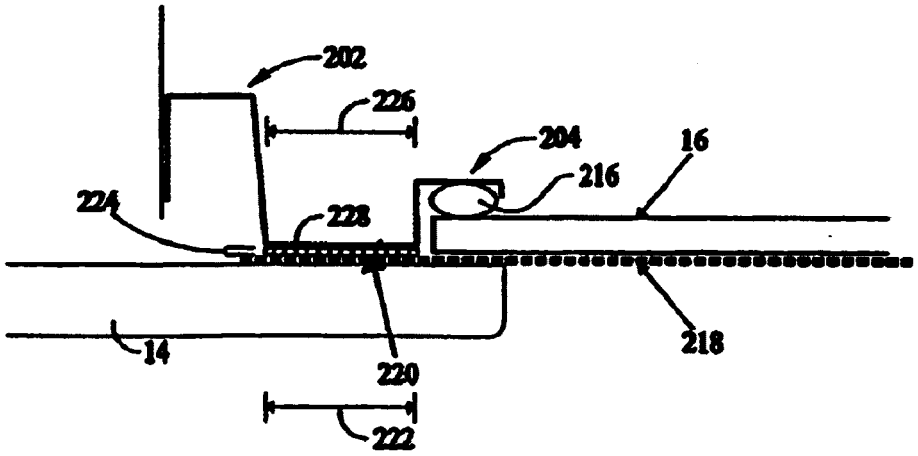
FIG. 10 is a side view of an exemplary embodiment of a metal screen that can be used with the choke assembly shown in FIG. 9.

FIG. 10 is a side view of an exemplary embodiment of a metal gasket 220 that can be used with choke assembly 200 (shown in FIG. 9). Metal gasket 220 includes a width 222, a thickness 224, and is positioned between metal screen 218 and door choke assembly 200. Gasket 220 facilitates preventing the passage of microwave energy between the screen 218 and choke 200, thereby allowing the product to meet regulatory requirements for RF emissions. In the exemplary embodiment, width 222 is approximately equal to a width 226, wherein width 226 is defined as a length of an extension piece 228 of choke assembly 200 adjacent to and contacting gasket 220. In one embodiment, metal gasket 220 is fabricated from a metallic mesh material, such as, but not limited to woven stainless steel wire. Perforated metal gasket 220 facilitates filling any gaps that may occur between choke assembly 200 and screen 218, thereby facilitating providing a barrier to microwave energy.

In use, screen 218 is positioned in door 14 of oven 10 to facilitate allowing an operator to view an interior of oven 10 while food is being cooked while providing a barrier to microwave energy. Since oven 10 facilitates both microwave and thermal cooking modes, any exposed metal in the cavity is generally coated with a porcelain enamel to facilitate preventing staining and corrosion of the metal surface at high temperatures. For example, in at least one known oven, a screen is incorporated into the door liner, the porcelain enameling process may fill the small perforations used to allow viewing the interior of the oven. Therefore, since screen 218 is fabricated using a stainless steel material, the interface between the edge of screen 218 and choke 202 is a potential leak path for microwave energy. Metal gasket 220 facilitates filling gaps between screen 218 and choke assembly 200 which may occur when either screen 218 or choke assembly 200 are not approximately flat, thereby reducing or eliminating any energy which may leak through this path.

Figure 11:
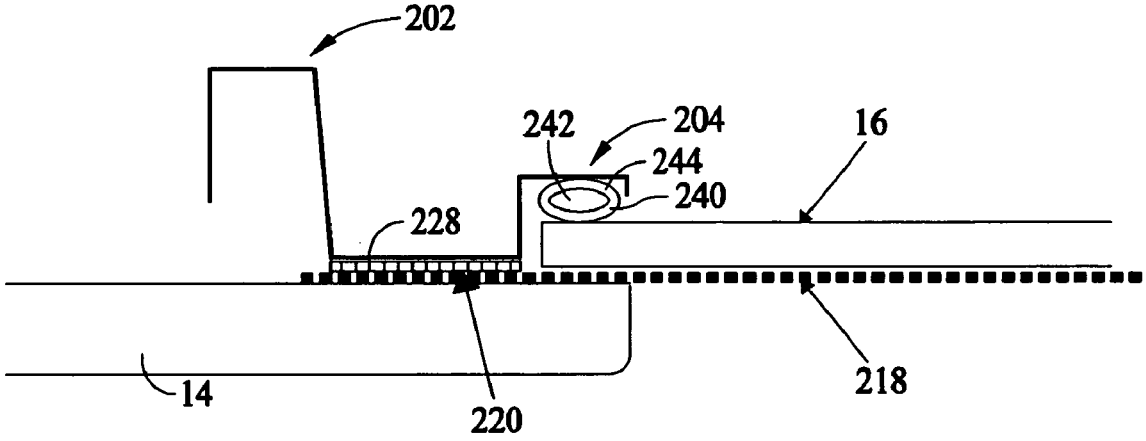
FIG. 11 is an end view of a gasket that can be used with the choke assembly shown in FIG. 9.

FIG. 11 is an end view of a gasket 240 that may be used with choke assembly 200 and screen 220. Gasket 240 includes a first portion 242 and a second portion 244 surrounding first portion 242. In the exemplary embodiment, first portion 242 is fabricated from a metallic mesh material, such as, but not limited to, a stainless steel mesh material, and second portion 244 is fabricated from a flexible material, such as, but not limited to, a fiberglass material. In the exemplary embodiment, gasket 240 is positioned at least partially within glass capture channel 204 such that gasket 240 is compressed between window 16 and choke assembly 200. Gasket 240 facilitates preventing a metal to glass contact while holding glass window 16 in a substantially fixed position with respect to door 14. Additionally, gasket 240 facilitates reducing or preventing vapor and moisture from an interior of oven 10 from exhausting to the exterior of oven 10.

In use, gasket 240 facilitates providing a stiffness sufficient to hold glass window 16 securely in door 14 to provide a vapor barrier. In addition, gasket 240 facilitates providing a compliant mount which facilitates preventing a mechanical stress caused by localized contact with glass capture channel 204. Additionally, since gasket 240 includes metal mesh core 242 and outer fiberglass sheath 244, gasket 240 remains compliant at increased temperatures, such as, but not limited to, a self clean temperature of approximately 900° Fahrenheit.

While the invention has been described in terms of various specific embodiments, those skilled in the art will recognize that the invention can be practiced with modification within the spirit and scope of the claims.

What is claimed is:

1. A microwave choke assembly comprising:

a microwave choke;

a glass capture channel coupled to said microwave choke, said glass capture channel comprises a first side, a second side substantially perpendicular to said first side, and a third side substantially perpendicular to said second side and substantially parallel to said first side; and a gasket positioned at least partially within said glass capture channel, said glass capture channel and a window separated by a first distance.

2. A microwave choke assembly in accordance with claim 1 wherein said microwave choke and said glass capture channel are fabricated unitarily.

3. A microwave choke assembly in accordance with claim 1 wherein said glass capture channel comprises:

a first side approximately 0.11 inches in length;

a second side substantially perpendicular to said first side, said second side approximately 0.23 inches in length; and a third side substantially perpendicular to said second side and substantially parallel to said first side, said third side approximately 0.40 inches in length.

4. A microwave choke assembly in accordance with claim 1 wherein said microwave choke assembly is fabricated from a metallic material and said gasket includes a non-metallic outermost coating.

5. A microwave choke assembly in accordance with claim 1 wherein said gasket comprises only an inner layer and an outer layer, said inner layer comprising a metallic mesh, said outer layer comprising a fiberglass material.

6. An oven comprising:

a cooking cavity;

an RF generation module positioned within said cooking cavity;

a convection fan positioned within said cooking cavity;

a window comprising an interior surface and an exterior surface, said window positioned within a door for viewing said cooking cavity; and a microwave choke assembly comprising:

a microwave choke;

a glass capture channel coupled to said microwave choke and extending along at least a portion of said interior surface of said window, said glass capture channel comprises a first side, a second side substantially perpendicular to said first side, and a third side substantially perpendicular to said second side and substantially parallel to said first side; and a gasket positioned at least partially within said glass capture channel, said glass capture channel and said window separated by a first distance; said gasket comprising only an inner layer and an outer layer, said inner layer comprising a metallic mesh, said outer layer comprising a fiberglass material.

7. A choke assembly for an oven, said oven having a door, said choke assembly comprising:

a microwave choke coupled to said door;

a glass capture channel;

an extension apparatus coupling said choke and said glass capture channel;

a first metallic screen positioned adjacent said door; and a metallic gasket positioned between said first metallic screen and said extension apparatus.

8. A choke assembly in accordance with claim 7 further comprising a gasket positioned at least partially within said glass capture channel, said glass capture channel and said window separated by a first distance.

9. A choke assembly in accordance with claim 7 wherein said extension apparatus includes a first width and said metallic gasket includes a second width approximately equal to said first width.

10. A choke assembly in accordance with claim 7 wherein said metallic gasket comprises:

a first side;

a second side; and a plurality of perforations extending from said first side to said second side.

11. A choke assembly in accordance with claim 7 wherein said metallic gasket comprises a stainless steel metallic screen.

12. A choke assembly in accordance with claim 7 wherein said microwave choke, said glass capture channel, and said extension apparatus are fabricated unitarily.

13. An oven comprising:

a cooking cavity;

a door coupled to said cooking cavity;

an RF generation module positioned within said cooking cavity;

a convection fan positioned within said cooking cavity;

a window positioned within said door for viewing said cooking cavity; and a microwave choke assembly comprising:

a microwave choke coupled to said door;

a glass capture channel;

an extension apparatus coupling said choke and said glass capture channel;

a first metallic screen positioned adjacent said door; and a metallic gasket positioned between said first metallic screen and said extension apparatus.

14. A speedcooking oven comprising:

a door;

a microwave choke coupled to said door;

a glass capture channel;

an extension apparatus coupling said choke and said glass capture channel;

a first metallic screen positioned adjacent said door; and a metallic gasket positioned between said first metallic screen and said extension apparatus.

15. A speedcooking oven in accordance with claim 14 wherein said microwave choke and said glass capture channel are formed unitarily.

16. A speedcooking oven in accordance with claim 15 wherein said speedcooking oven further comprises a gasket positioned at least partially within said glass capture channel, said glass capture channel and said window separated by a first distance; said gasket comprising only an inner layer and an outer layer, said inner layer comprising a metallic mesh, said outer layer comprising a fiberglass material.

17. A method for sealing a window in a speedcook oven, said speedcook oven comprising:

a cooking cavity;

an RF generation module positioned within said cooking cavity;

a convection fan positioned within said cooking cavity;

a window comprising an inner surface and an outer surface, said window positioned within a door for viewing said cooking cavity; and a microwave choke assembly; said choke assembly comprising:

a microwave choke; and a glass capture channel coupled to said microwave choke, said glass capture channel comprises a first side, a second side substantially perpendicular to said first side, and a third side substantially perpendicular to said second side and substantially parallel to said first side;

said method comprising:

positioning a gasket at least partially within the glass capture channel along at least a portion of said inner surface of said window, the glass capture channel and the window separated by a first distance; the gasket comprising only an inner layer and an outer layer, the inner layer comprising a metallic mesh, the outer layer comprising a fiberglass material.

18. A method in accordance with claim 17 further comprising coupling the choke and the glass capture channel using an extension apparatus.

19. A method in accordance with claim 18 further comprising:

positioning a first metallic screen adjacent the door; and positioning a metallic gasket between the first metallic screen and the extension apparatus, wherein the extension apparatus includes a first width and the metallic gasket includes a second width approximately equal to the first width.

* * * * *